US009939152B2

(12) United States Patent
Hannemann et al.

(10) Patent No.: US 9,939,152 B2
(45) Date of Patent: Apr. 10, 2018

(54) COMBINATION OF PRESSURE CHARGING AND METERING FOR CONTINUOUSLY SUPPLYING PULVERIZED FUEL INTO AN ENTRAINED-FLOW GASIFYING REACTOR WITH LONG CONVEYING DISTANCES

(71) Applicants: Frank Hannemann, Freiberg (DE); Manfred Schingnitz, Freiberg (DE)

(72) Inventors: Frank Hannemann, Freiberg (DE); Manfred Schingnitz, Freiberg (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 975 days.

(21) Appl. No.: 14/037,712

(22) Filed: Sep. 26, 2013

(65) Prior Publication Data

US 2014/0090583 A1 Apr. 3, 2014

(30) Foreign Application Priority Data

Oct. 1, 2012 (DE) ..... 10 2012 217 890

(51) Int. Cl.
*B65G 51/36* (2006.01)
*F23K 3/02* (2006.01)
(Continued)

(52) U.S. Cl.
CPC ..... *F23K 3/02* (2013.01); *C10B 31/00* (2013.01); *C10J 3/506* (2013.01); *F23N 1/02* (2013.01);
(Continued)

(58) Field of Classification Search
CPC ... C21B 5/003; F23K 3/02; C10J 3/723; C10J 3/506; C10J 2300/093; B65G 53/66
(Continued)

(56) References Cited

U.S. PATENT DOCUMENTS 3,167,421 A * 1/1965 Pfeiffer ..... C21B 5/003 110/347
3,689,045 A * 9/1972 Coulter ..... C21B 5/003 266/182
(Continued)

FOREIGN PATENT DOCUMENTS

CN 1063892 A 8/1992
CN 1721511 A 1/2006
(Continued)

*Primary Examiner* — William R Harp

(57) ABSTRACT

A system for fluidizing and conveying a powdery product is provided. The system includes plurality of powder-locking and metering vessels, the vessels each having a conveying line for the powdery product and a control mechanism for the mass flow of the powdery product. The conveying lines are brought together to form a common conveying line and are supplied to a remover of the powdery product. The powder-locking and metering vessels are alternatively fed with the powdery product and tensioned with the fluidizing gas under operating pressure. The control mechanisms of the powder-locking and metering vessels are activated in such a manner that the mass flow sum of powdery product in the conveying lines is identical to the desired value for the mass flow of powdery product to the remover of the powdery product.

12 Claims, 3 Drawing Sheets

(51) Int. Cl.
*C10B 31/00* (2006.01)
*F23N 1/02* (2006.01)
*C10J 3/50* (2006.01)

(52) U.S. Cl.
CPC .. *C10J 2300/093* (2013.01); *C10J 2300/0906* (2013.01); *C10J 2300/0909* (2013.01); *F23K 2201/101* (2013.01); *F23K 2201/20* (2013.01); *F23K 2203/103* (2013.01); *F23K 2203/104* (2013.01); *F23K 2203/105* (2013.01); *F23K 2203/201* (2013.01)

(58) Field of Classification Search
USPC ..... 406/29, 127
See application file for complete search history.

(56) References Cited

U.S. PATENT DOCUMENTS 4,017,269 A * 4/1977 Dutz ..... C10J 3/30 110/101 C
4,381,897 A 5/1983 Boelcke
5,123,632 A * 6/1992 Schmit ..... B01F 3/188 266/47
8,858,123 B2 * 10/2014 Schmit ..... F23K 3/02 110/105
8,899,884 B2 * 12/2014 Kretschmer ..... C10J 3/723 406/10
2011/0232547 A1 * 9/2011 Schmit ..... F23K 3/02 110/263
2012/0257934 A1 10/2012 Eichhorn

FOREIGN PATENT DOCUMENTS

CN 2808837 Y 8/2006
CN 1944593 A 4/2007
CN 101679886 A 3/2010
CN 101965223 A 2/2011
CN 102245745 A 11/2011
CN 102648377 A 8/2012
DE 147188 A3 3/1981
DE 274278 A1 12/1989
DE 102008052673 A1 4/2010
DE 102009035408 A1 2/2011
DE 102009048931 A1 4/2011

* cited by examiner

COMBINATION OF PRESSURE CHARGING AND METERING FOR CONTINUOUSLY SUPPLYING PULVERIZED FUEL INTO AN ENTRAINED-FLOW GASIFYING REACTOR WITH LONG CONVEYING DISTANCES

CROSS REFERENCE TO RELATED APPLICATIONS

This application claims priority of German Patent Office application No. 102012217890.2 DE filed Oct. 1, 2012. All of the applications are incorporated by reference herein in their entirety.

FIELD OF INVENTION

The invention relates to a system for fluidizing and conveying a powdery product, in particular pulverized fuel, overcoming conveying distances of 80 to 500 m, at an operating pressure of up to 10 MPa, to a receiver, in particular an entrained-flow gasifying device.

The invention also relates to a method for continuously feeding pulverized fuel into an entrained-flow gasifying plant at pressures of up to 10 MPa for producing a CO- and H2-rich crude gas which can be processed to form various synthesis gases, high-energy gases and hydrogen.

BACKGROUND OF INVENTION

The pulverized fuel is supplied to the gasifying system, which is under a pressure of up to 10 MPa, either by pump conveying of a pulverized fuel/water slurry, a pulverized fuel/oil slurry or a pulverized fuel/carrier gas suspension at conveying densities of 250-450 kg/m$^3$ in the continuous-conveying sphere. An extensive description of this technology is contained in patent DD 147188 A3. According thereto, the pulverized fuel produced in a grinding and drying plant is supplied by conventional thin-flow conveying to an operating bunker and the conveying gas is separated off via a filter. To increase the pressure, the pulverized fuel passes via gravitational conveying into pressure locks, in which the powder is brought to the desired process pressure by tensioning with an inert gas having less than 5% oxygen. Nitrogen, carbon dioxide or exhaust gases from the combustion can be used as inert gases. Depending on the output, the pressure locks may be in single or multiple form. The pulverized fuel passes out of the pressure locks, again by gravitational conveying, into a metering vessel, in the lower part of which there is a device for producing a dense fluidized bed, into which one or more conveying lines for transporting the pulverized fuel to the burner of the gasifying reactor are submerged. By setting and optionally controlling a specified pressure differential between the metering vessel and the gasifying reactor, the desired amount of pulverized fuel can be supplied. Together with the amount of oxygen which is matched to the amount of pulverized fuel, the conversion in the gasifying reactor takes place at temperatures such that the fuel ash is melted to form liquid slag. This arrangement conceals a plurality of disadvantages. The amount of fuel to be supplied in the thin flow from a grinding and drying plant over a relatively large distance to the operating bunker of the gasifying plant requires a very large amount of conveying gas which has to be provided continuously. The arrangement of an operating bunker containing several thousand tons of pulverized fuel and of the locks and the metering vessel in the region of the hot gasifying reactor may result, in the event of leakages or of damage, to severe fires which may lead to destruction of the entire plant. In order to avoid these disadvantages, it was proposed in laid-open specifications DE 102008052673 and in DE 102009035408 to arrange the bunker and lock system in the region of the grinding and drying plant and to site only a metering vessel in the region of the hot gasifying reactor. In order to overcome the relatively long transport route, use should also be made here of dense-flow conveying. A disadvantage in this case is the serial arrangement of two metering vessels. The coal ground up to form pulverized fuel is supplied to an operating bunker via a filter, as customary, and is placed under process pressure in one or more locks. By means of gravitational conveying, the pulverized fuel enters a first metering vessel, from which it is supplied in the dense flow to a second metering vessel which is located in the direct vicinity of the gasifying reactor. The pulverized fuel is separated therein from the conveying gas, thereby building up a pile. The lower part again contains a device which permits feeding of one or more powder-conveying lines which supply the pulverized fuel in the dense flow to a central gasifying burner or to a plurality of gasifying burners of the gasifying reactor. The saving on conveying gas by using dense flow technology and the local separation of powder-conducting large containers from the hot-running gasifying reactor are advantageous in this case; the design of the metering system in multiple form is disadvantageous. Furthermore, there is the risk that, in the case of a relatively large distance between the two metering systems, the transport speed of the gas/powder suspension becomes so high, because of the pressure loss and associated expansion of the conveying gas, that wear may occur in the conveying lines. The risk increases the lower the pressure level is.

SUMMARY OF INVENTION

The invention is based on the object of, in the case of an entrained-flow gasifying plant with pneumatic supply of pulverizing fuel, supplying said pulverized fuel directly by a metering vessel, which is connected to the grinding and drying plant for producing the pulverized fuel, to the burners of the gasifying reactor, even over relatively long transport routes, without further intermediate stages by means of continuously conveying at high densities of between 250 to 450 kg/m$^3$.

The object is achieved by a system with the features of the independent claim(s).

Within the scope of the invention, the pulverized fuel which comes from the grinding and drying plant is separated from the drying and circulating gas in a filter and is passed to a metering vessel in which the pressurization and the metering into the transport line to the entrained-flow gasifying plant are combined. For this purpose, there are at least two or more pressure locks 5 which are each fed discontinuously from said filter 4 by gravitational conveying and begin the conveying following pressurization. According to the prior art, for this purpose the lower part has fluidizing plates via which, by supply of fluidizing gas, a fluidized bed, in which the powder-conveying line 6 starts, is built up. The powder-locking and metering vessels 5 are operated alternately in respect of the charging with operating pressure. In this case, at least one metering vessel is always filled and is subsequently tensioned, and a further metering vessel is kept under the operating pressure of, for example, 4.7 MPa and the pulverized fuel is fluidized in the fluidizing shaft. The pulverized fuel, in particular pulverized coal, is continuously conveyed from said locking and metering vessel into the gasifying reactor. The amount is controlled here by a control valve 11 arranged at the outlet of the metering vessel. The powder-conveying lines of a plurality of locking and metering vessels are combined downstream of the control valves to form a common conveying line 14, but can also be divided further in long conveying distances into a plurality of divided conveying lines (14*a*, 14*b*, 14*c*). In order to ensure continuous operation, a switch is made to a second vessel before the emptying of the locking and metering vessel which is in operation. This takes place after the filling and tensioning operation thereof is finished. The desired value 9, 21 for the mass flow control of the coal is subsequently divided between the control valve of the first and second metering vessels, wherein the desired value is displaced from the first valve to the second valve via what is referred to as a portion divider. The desired value is displaced here via a ramp, the time (t1) of which can be set, as illustrated in FIG. 3.

The ramp exit is multiplied by the desired value of the mass flow for the second valve and, for the first valve, the ramp exit is subtracted from 1 and then multiplied by the desired value of the mass flow. In this manner, consistent conveying into the gasifying reactor during the switching-over/changing-over can be ensured. In parallel to the activation of the control devices (11) for the pulverized fuel, which are arranged below the locking and metering vessel, the supply of fluidizing gas (17) into the lower part of the fluidizing plates is started. This ideally takes place temporally before the beginning of the conveying of the coal, in order to achieve a stable fluidized bed.

No limitation of the conveying of the coal is required because of the conversion/changing-over of the desired value and the individual control of each locking and metering vessel. The possible flow speeds of 2 to 8 m/s for the dense-flow conveying are maintained throughout the entire course of the powder-conveying line.

By means of the alternate switching-on of a plurality of said locking and metering vessels, a continuous supply of the pulverized fuel to the gasifying reactor can be ensured despite the discontinuity in the operation of the pressure vessels.

The invention results in a considerable reduction in outlay and, by means of the possibility of siting the locking and metering vessels at a far distance from the gasifying reactor, in an increase in the safety in the surroundings of the hot gasifying reactor.

Advantageous developments of the invention are specified in the dependent claims.

BRIEF DESCRIPTION OF THE DRAWINGS

The invention is explained in more detail below as an exemplary embodiment to an extent required for understanding and with reference to figures, in which.

DETAILED DESCRIPTION OF INVENTION

In the figures, the same designations denote identical elements.

Example 1

Figure 1:
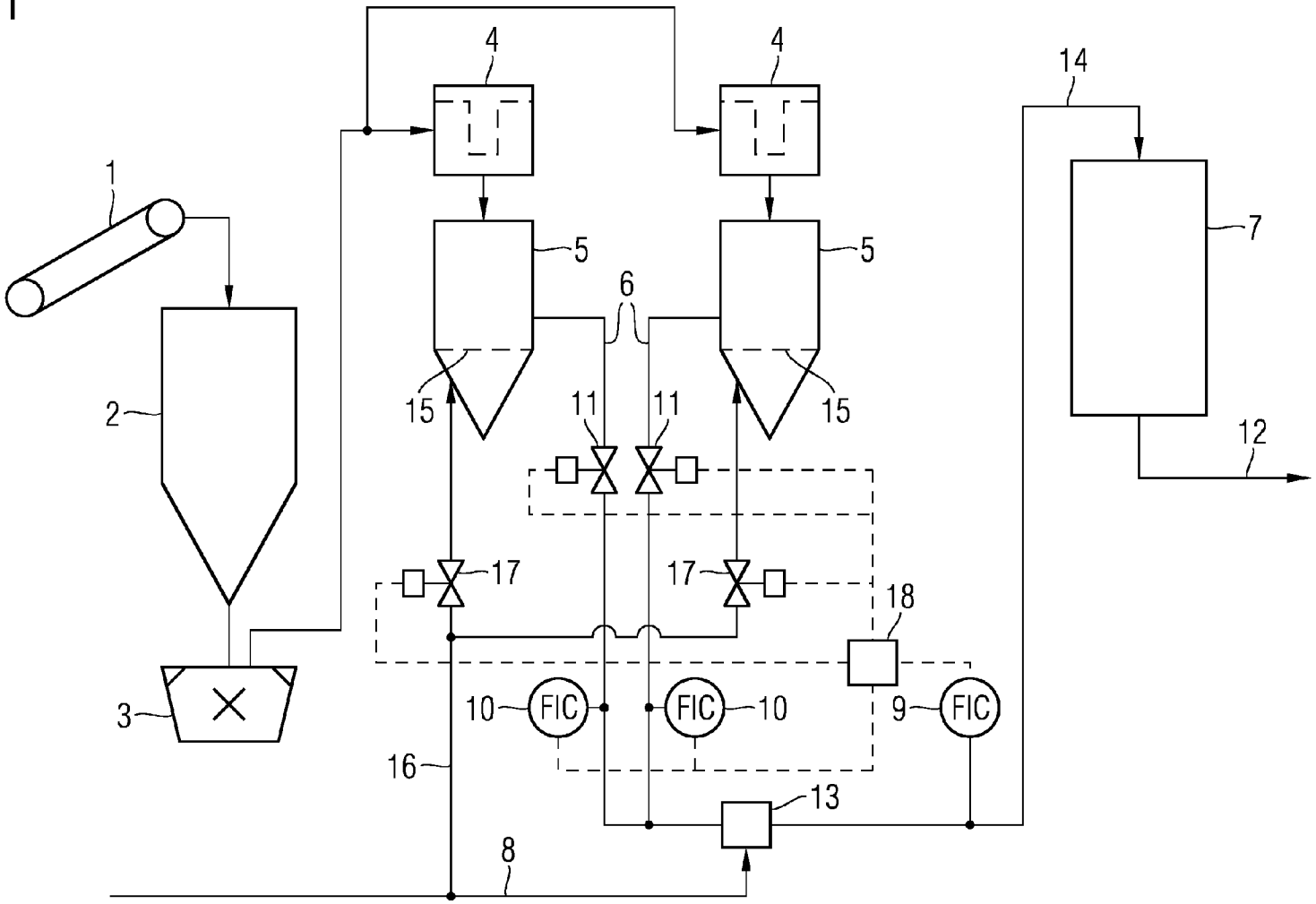
FIG. 1 shows the interaction according to the invention of essential elements of a coal-grinding and drying plant with the gasifying plant.

A gasifying plant according to FIG. 1 for producing synthesis gas has a gross capacity of 500 MW. Pulverized fuel is required at 82 Mg/h. For this purpose, the raw coal is passed by raw-coal conveying technology 1 to a raw coal silo 2 and is processed in the two-line drying and grinding plant 3 to form a pulverized fuel with a residual water content of 2.5 Ma % and a 50 Ma % grain size of smaller than 60 μm. Said pulverized fuel is separated from drying and circulating gas in the powder filter 4. The powder temperature is 50° C. There are a total of three combined pressure and metering locks 5 (only two are shown) which are fed alternately by gravitational conveying from the powder filters 4 and are tensioned by supply of oxygen-free or low-oxygen gas. As a result, despite the discontinuous filling and tensioning operation of the combined powder-locking and metering vessels, a continuous supply of powder from the powder-conveying lines 6 and the line 14 to the gasifying reactor 7 can be achieved. The tensioning pressure in the pressure and metering locks 5 corresponds to the pressure in the entrained-flow gasifying reactor 7 plus the pressure loss in the powder-conveying lines 6 and 14. The tensioning gases can be provided by nitrogen, carbon dioxide, low-oxygen exhaust gases, but also combustible gases, such as natural gas or residual gases from the entire process. The combined powder-locking and metering vessel 5 can be tensioned, for example, with the fluidizing gas 16 which is supplied below the fluidizing plate 15. In this case, the pulverized fuel is already loosened by the fluidizing plate 15. If the desired operating pressure is reached, the conveying of the pulverized fuel can begin by opening of the valve 11 and, by means of the quantity-measuring means 9, which activates the control valve 11, and optionally by means of additional gas 8 being supplied to the powder-conveying line 14, the desired amount of fuel can be set. The pulverized fuel is supplied via the powder-conveying line 14 to the gasifying reactor 7, in which the conversion with the gasifying means oxygen and optionally steam, but also carbon dioxide to form gasifying gas is undertaken. The gasifying gas is supplied to corresponding plants/devices for further treatment via the line 12. The powder-conveying lines 6 and 14 can have dimensions of between 10 and 100 mm. The distance between the combined powder-locking and metering vessel 5 and the gasifying reactor 7 is 200 m.

During the desired supply of powder, a pressure loss between the vessel 5 and the entrained-flow gasifying reactor 7 of 0.7 MPa arises at an overall plant pressure of 4.7 MPa. This corresponds to approximately 15% of the overall pressure. This value can be up to 20%.

In order to ensure continuous operation, before the complete emptying of the locking and metering vessel 5 which is in operation, the switch is made to a second locking and metering vessel 5 without the continuity of the powder flow in line 14 being disturbed. This takes place after the filling and tensioning operation of the second locking and metering vessel 5 is finished. The desired value for the mass flow control of the coal of 82 Mg/h is subsequently divided between the control valves 11 of the first and second locking and metering vessels 5, wherein the portion divider 18 conducts the desired value from the first valve to the second valve. The desired value here is displaced by a ramp, the time t1 of which can be set. The ramp exit is multiplied by the desired value of the mass flow for the second control valve 11 and, for the first control valve 11, the ramp exit is subtracted from 1 and multiplied by the desired value of the mass flow. In this manner, constant conveying into the gasifying reactor 7 during the readjustment to the other locking and metering vessel 5 can be ensured. A further influencing of the powder flow control, in particular also fine control, can be undertaken by the control valves 17 located in the fluidizing gas line 16 or by the supply of additional gas 8 into the auxiliary gas feed 13 of the powder-conveying line 14.

Example 2

Figure 2:
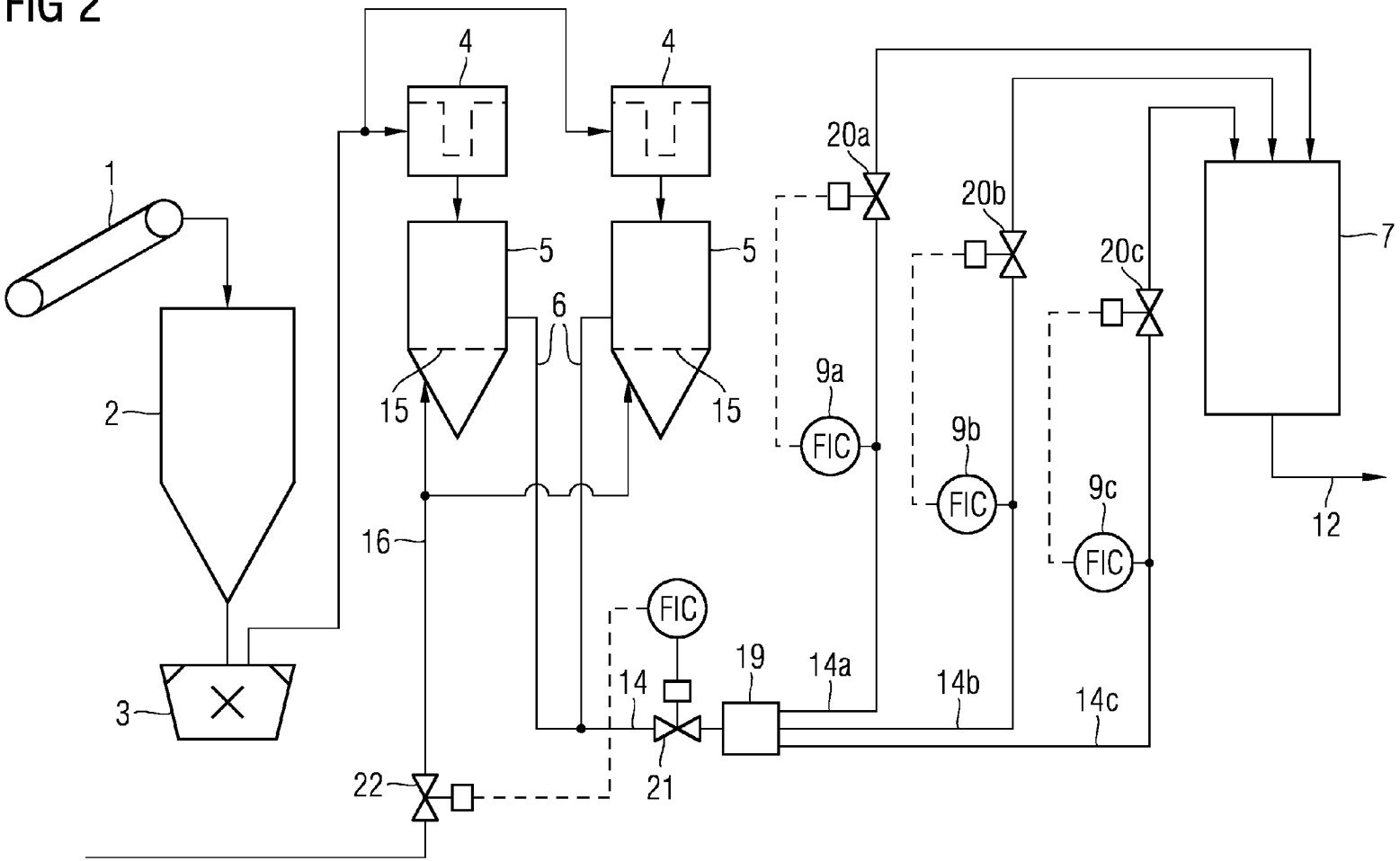
FIG. 2 shows a particular solution for large conveying lengths.
Figure 3:
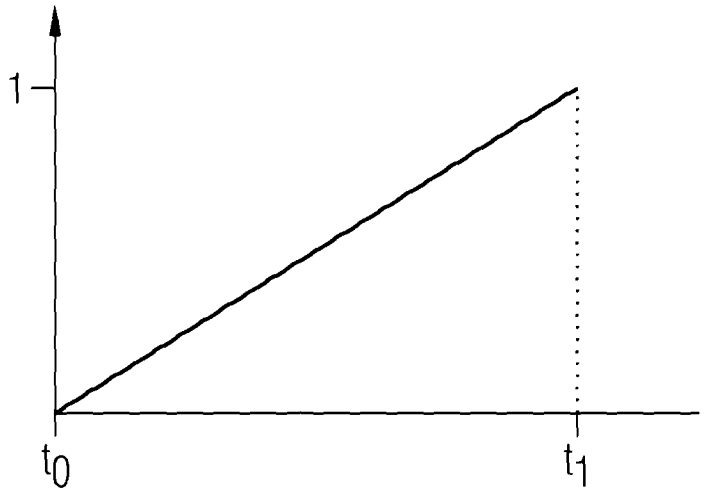
FIG. 3 shows the changing-over from one metering vessel to another metering vessel within a time period of t0 to t1.

A gasifying plant according to FIG. 2, simplified and illustrated without 11, 17, 18, provides the same capacity as in Example 1. The distance between the combined powder-locking and metering vessels 5 and the entrained-flow gasifying reactor 7 is approx. 500 m. In order to limit the pressure loss in the powder-conveying lines 6 and 14 and also to keep the flow speed below 8.5 m/s, a powder flow divider 19 is inserted into the powder-conveying line 14 after a distance of 250 m, said powder flow divider dividing the powder flow uniformly between the three powder-conveying lines 14*a, b, c*. The three powder-conveying lines 14*a, b, c* can be connected to the three galvanized-fuel supply means of a high-power burner or in each case to the pulverized-fuel supply means of one of three burners. The further operation corresponds to Example 1.

A quantity-measuring means and controller for the entire powder flow 21 can be arranged in the powder-conveying line 14 common to the powder-locking and metering vessels 5. In accordance with the mass flow determined in the quantity-measuring means and controller for the entire powder flow 21, the quantity of fluidizing gas flowing into the powder-locking and metering vessels 5 in total is controllable via a control valve for the entire amount of fluidizing gas 22 in the fluidizing gas line 16 with the effect of a master control means.

Example 3

An entrained-flow gasifying plant with an output of likewise 500 MW is supplied with 82 Mg/h of pulverized fuel over a distance of 500 m, said pulverized fuel being placed under pressure in three combined powder-locking and metering vessels 5 and being fed into the powder-conveying lines 14. The diameters of the conveying lines are 0.06 m. In order to limit the pressure loss in the powder-conveying lines and the flow speed of the gas and pulverized fuel suspension the cross sections of said lines are doubled after a conveying distance of 250 m such that the diameters thereof are increased to 0.085 m.

The invention is also provided by a system for the pneumatic feeding-in of pulverized fuel according to the continuous-conveying principle in an entrained-flow gasifying reactor 7, in particular overcoming conveying distances of 80 to 500 m, in which a H2- and CO-rich crude gas is produced by conversion of gasifying means with oxygen or containing free oxygen at pressures of between 1 and 10 MPa and temperatures between 1300 and 1600° C., wherein an untreated fuel stored in an untreated fuel silo 2 is supplied to a device 3 for drying and grinding the fuel to form powdery fuel, the pulverized fuel is subsequently freed from the entrained drying and circulating gas in the filter 4, in a combined powder-locking and metering vessel 5, the pulverized fuel is set under operating pressure and is introduced in the fluidized state and in a defined flow into a powder-conveying line 14, in the fluidized state, the pulverized fuel is supplied by means of continuous conveying through the powder-conveying line 14 to the entrained-flow gasifying reactor 7, there are a plurality of combined powder-locking and metering vessels 5 which are discontinuously (cyclically) filled with pulverized fuel and set under pressure and the content of which is supplied continuously to the entrained-flow gasifying reactor 7 by, after the filling and tensioning operation, the desired value for the mass-flow control of the pulverized fuel being divided between the control valves 11 of the powder-conveying lines 6 of the first and second powder-locking and metering vessels 5, wherein the desired value is displaced from the first control valve 11 to the second control valve 11 via a portion divider 18 and, in the process, the desired value is displaced via a ramp, the time t1 of which can be set, and the ramp exit is multiplied by the desired value of the mass flow for the second control valve 11 and, for the first control valve, the ramp exit is subtracted from 1 and multiplied by the desired value of the mass flow, wherein, in parallel to the activation of the control valves 11, the supply of fluidizing gas 16 under the fluidizing plates 15 is started and the conveying begun.

The invention claimed is:

1. A system for the pneumatic feeding-in of pulverized fuel in which a H2- and CO-rich crude gas is produced by conversion of an entrained-flow gasifying reactor with oxygen or containing free oxygen, comprising:

an untreated fuel stored in an untreated fuel silo is supplied to a device below the untreated fuel silo for drying and grinding the fuel to form powdery fuel, a filter, wherein the pulverized fuel is subsequently freed from an entrained drying and circulating gas as the pulverized fuel is passed through the filter, a plurality of combined powder-locking and metering vessels that are discontinuously or cyclically filled with the pulverized fuel and tensioned with fluidizing gas set under operating pressure, wherein the pulverized fuel is set under operating pressure and is introduced in a fluidized state, each of the combined powder-locking and metering vessels convey a defined flow of the fluidized pulverized fuel via an allocated powder-conveying line and an allocated control valve into a common conveying line, the entrained-flow gasifying reactor, wherein in the fluidized state, the pulverized fuel is supplied by continuous conveying through the common conveying line to the entrained-flow gasifying reactor, wherein the fluidized pulverized fuel is supplied continuously to the entrained-flow gasifying reactor by the desired value for mass-flow control of the pulverized fuel divided between the control valves of the powder-conveying lines of the plurality of combined powder-locking and metering vessels, a portion divider that displaces the desired value from a first control valve of the control valves to a second control valve of the control valves, wherein the desired value is displaced via ramping within the portion divider, wherein the time of the ramping is set, wherein the ramping exit out of the portion divider is multiplied by the desired value of the mass flow for the second control valve and, for the first control valve, the ramping exit out of the portion divider is subtracted from 1 and multiplied by the desired value of the mass flow, wherein in parallel to the activation of the control valves, a supply of fluidizing gas of the respective combined powder-locking and metering vessel assigned to the second control valve under fluidizing plates is started and the conveying begin.

2. The system as claimed in claim 1, wherein the mass flow of powdery fuel output by a powder-locking and metering vessel is controllable in accordance with the setting of the respective control valve, which is associated with said combined powder-locking and metering vessel, in the associated conveying line.

3. The system as claimed in claim 1, wherein the mass flow of powdery fuel output by a powder-locking and metering vessel is controllable in accordance with the amount of fluidizing gas set in a fluidizing gas line via the respective control valve associated with said combined powder-locking and metering vessel.

4. The system as claimed in claim 1, wherein the powdery fuel of the common powder-conveying line is dividable by a powder flow divider into a plurality of divided-up conveying lines connecting the divider with the entrained-flow gasifying reactor.

5. The system as claimed in claim 4, wherein that said system is dimensioned in such a manner that the ratio of the cross section of the divided-up conveying lines to the conveying line is 1.5 to 3 times.

6. The system as claimed in claim 1, wherein the diameter of the powder-conveying line is increased over the conveying length, wherein the flow speed is reducible by up to half by expansion of the powder-conveying line.

7. The system as claimed in claim 1, wherein said system is dimensioned in such a manner that the pressure loss in the powder-conveying lines is at maximum 20% of the pressure in the metering vessel.

8. The system as claimed in claim 1, wherein the pulverized fuel is supplied to the powder-locking and metering vessels from the device for drying and grinding.

9. The system as claimed in claim 1, wherein the fluidizing gas is provided by an inert gas.

10. The system as claimed in claim 1, wherein the entrained-flow gasifying reactor converts the pulverized fuel into crude gas.

11. The system as claimed in claim 1, further comprising an auxiliary gas line connected to a powder conveying line.

12. The system as claimed in claim 1, wherein the system is configured for overcoming conveying distances of 80 to 500 m, under an operating pressure of up to 10 MPa.

* * * * *